US008721468B1

(12) United States Patent
Barrett

(10) Patent No.: US 8,721,468 B1
(45) **Date of Patent: *May 13, 2014**

(54) GOLF BALL WITH INDICIA FOR ALIGNMENT

(71) Applicant: W. Raymond Barrett, St. Louis, MO (US)

(72) Inventor: W. Raymond Barrett, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/685,335

(22) Filed: Nov. 26, 2012

Related U.S. Application Data

(63) Continuation-in-part of application No. 29/431,250, filed on Sep. 5, 2012, and a continuation-in-part of application No. 13/357,361, filed on Jan. 24, 2012, which is a continuation-in-part of application No. 29/388,964, filed on Apr. 5, 2011, now Pat. No. Des. 655,358.

(60) Provisional application No. 61/483,999, filed on May 9, 2011.

(51) Int. Cl.
*A63B 69/36* (2006.01)
*A63B 37/00* (2006.01)

(52) U.S. Cl.
USPC ..... 473/280; 473/200; 473/251

(58) Field of Classification Search
USPC ..... 473/131, 200, 280, 351, 378, 409
See application file for complete search history.

(56) References Cited

U.S. PATENT DOCUMENTS

| | | | | | |
|---|---|---|---|---|---|
| 109,204 | A | | 11/1870 | Hartz | |
| D5,556 | S | | 2/1872 | Pettengill | |
| D20,187 | S | | 10/1890 | Herrick | |
| D27,441 | S | * | 7/1897 | Dunn | D21/709 |
| 676,506 | A | | 6/1901 | Knight et al. | |
| D55,413 | S | * | 6/1920 | Cigol | D21/713 |
| D61,805 | S | | 1/1923 | Griffiths | |
| D61,806 | S | * | 1/1923 | Griffiths | D21/714 |
| D141,546 | S | * | 6/1945 | Glass | D21/714 |
| 2,707,595 | A | | 5/1955 | Brown | |
| 2,709,595 | A | * | 5/1955 | De Vries | 473/200 |
| 3,318,598 | A | * | 5/1967 | Ruskin | 473/55 |

(Continued)

FOREIGN PATENT DOCUMENTS

| | | |
|---|---|---|
| CN | D300788288 | 6/2008 |
| CN | D300897422 | 3/2009 |

(Continued)

OTHER PUBLICATIONS

Taylor Made Golf, "Easy-To-See Alignment Lines", <http://www.taylormadegolf.com/products/putters/Ghost-Series-putter/product-detail-technology/params/easy-to-see-alignment-line-technology>, dated May 5, 2011, 2 pages.

(Continued)

*Primary Examiner* — Nini Legesse
(74) *Attorney, Agent, or Firm* — Senniger Powers LLP

(57) ABSTRACT

A golf ball has indicia adapted to allow a user to align the indicia with at least one of an intended direction of travel of the ball and a club head of a club the user will use to strike the ball. The indicia can be three parallel lines extending around a portion the golf ball. A golf club can be provided with a marking on the club head adapted to align with the indicia on the golf ball.

20 Claims, 12 Drawing Sheets

(56) References Cited

U.S. PATENT DOCUMENTS

| | | | | |
|---|---|---|---|---|
| 3,829,348 | A | 8/1974 | Spiegel et al. | |
| 4,209,172 | A | 6/1980 | Yamamoto | |
| 4,235,441 | A | 11/1980 | Ciccarello | |
| 4,258,921 | A | 3/1981 | Worst | |
| 4,266,773 | A * | 5/1981 | Treadwell | 473/383 |
| 4,603,862 | A | 8/1986 | Chen | |
| 4,741,535 | A | 5/1988 | Leonhardt | |
| 4,991,838 | A | 2/1991 | Groves | |
| 5,133,556 | A | 7/1992 | Karasavas | |
| D329,485 | S | 9/1992 | Hollinger | |
| 5,427,378 | A * | 6/1995 | Murphy | 473/353 |
| 5,437,446 | A | 8/1995 | Youngkin | |
| 5,439,224 | A | 8/1995 | Bertoncino | |
| D369,192 | S | 4/1996 | Imswiler | |
| D370,705 | S | 6/1996 | Cullen, III | |
| 5,564,707 | A | 10/1996 | Dinh | |
| 5,662,530 | A | 9/1997 | Sellar | |
| 5,713,799 | A * | 2/1998 | Balmat | 473/200 |
| D408,481 | S | 4/1999 | Disco | |
| D411,599 | S | 6/1999 | Sullivan | |
| D414,229 | S * | 9/1999 | Sohn | D21/709 |
| D415,541 | S * | 10/1999 | Stahl et al. | D21/709 |
| D417,477 | S | 12/1999 | Sullivan | |
| 6,213,012 | B1 | 4/2001 | Arms | |
| 6,231,459 | B1 | 5/2001 | Pettigrew et al. | |
| D458,978 | S | 6/2002 | Lombardi | |
| 6,422,949 | B1 | 7/2002 | Byrne et al. | |
| 6,453,807 | B1 | 9/2002 | Ramey | |
| D487,911 | S | 3/2004 | Cheney | |
| D523,100 | S | 6/2006 | Sano | |
| 7,223,178 | B2 | 5/2007 | Henry | |
| D544,930 | S * | 6/2007 | Farrell | D21/713 |
| 7,691,005 | B2 | 4/2010 | Mitsuba | |
| D627,020 | S | 11/2010 | Martin | |
| 7,963,869 | B2 * | 6/2011 | Boyer et al. | 473/604 |
| D655,358 | S | 3/2012 | Barrett | |
| D669,550 | S | 10/2012 | Nelson | |
| 8,403,768 | B2 | 3/2013 | Aittola | |
| 2001/0036870 | A1 * | 11/2001 | Pettigrew et al. | 473/351 |
| 2002/0002086 | A1 | 1/2002 | Inoue et al. | |
| 2003/0144068 | A1 | 7/2003 | Yang | |
| 2004/0220001 | A1 | 11/2004 | Oister et al. | |
| 2005/0170920 | A1 * | 8/2005 | Boyer et al. | 473/570 |
| 2006/0293113 | A1 * | 12/2006 | Pelz | 473/280 |
| 2007/0084095 | A1 | 4/2007 | Wellington, Jr. | |
| 2008/0096691 | A1 | 4/2008 | Kang | |
| 2008/0305880 | A1 | 12/2008 | Brown | |
| 2011/0207553 | A1 | 8/2011 | Reid et al. | |
| 2012/0028726 | A1 | 2/2012 | Aittola | |
| 2012/0258815 | A1 | 10/2012 | Barrett | |

FOREIGN PATENT DOCUMENTS

| | | |
|---|---|---|
| CN | 301968362 | 6/2012 |
| GB | D2043359 | 1/1996 |
| GB | D2051948 | 1/1996 |
| GB | D2077843 | 2/1999 |
| WO | 00/67853 | 11/2000 |
| WO | D071271-022 | 1/2009 |
| WO | 2012/138598 A2 | 10/2012 |

OTHER PUBLICATIONS

Ping, "Easy Alignment", <http://www.ping.com/clubs/puttersdetail.aspx?id=8499&tid=515>, dated May 5, 2011, 1 page.

TaylorMade Monza Rossa Putter, <http://www.bestvaluegolf.com/tamamopu.html>, 1 page.

Scotty Cameron, "Studio Select® Squareback 1", <http://www.scottycameron.com/putters/puttermodel.aspx?id=386>, dated May 5, 2011, 1 page.

Scotty Cameron, "Studio Select® Fastback 1.5", <http://www.scottycameron.com/putters/puttermodel.aspx?id=385>, dated May 5, 2011, 1 page.

Edel Golf (http://edelgolf.com), Edel Golf and AimPoint Technologies Form Strategic Partnership, Press Release, pp. 1-2, Jan. 28, 2010, Austin, Texas (http://edelgolf.com/index.php?option=com_content&task=article&id=22&Itemid=14&j=nsw).

Sayim, Bilge et al., Contrast polarity, chromaticity, and stereoscopic depth modulate contextual interactions in vernier acuity, Journal of Vision, http://jov.journalofvision.org/8/8/12/article.aspx, Feb. 9, 2011, 15 pages.

D.W. Quail Golf, In-Line Golf Ball Line Marking Kit, http://www.dwquailgolf.com/training/inline.html, Jun. 29, 2011, 2 pages.

Golfer's Avenue, Golf Putting Aids, http://www.golfersavenue.com/golf-putting-aids.html, Jun. 27, 2011, 2 pages.

Westheimer, G., Visual Acuity, In Moses RA, Hart WM, editor. Chapter 7 of Adler's Physiology of the Eye, Ninth Edition, Clinical application St. Louis, Missouri: The C.V. Mosby Company, 1987, 19 pages.

Striped Table Tennis Ball shown on webpage: http://www.activinstinct.com/table-tennis/balls/adidas-stripes-table-tennis-ballbox-of-6/# Retrieved on Aug. 21, 2010, 1 page.

Westheimer, G., Visual acuity and spatial modulation thresholds. In: Jameson D., Hurvich LM, editor. Handbook of sensory physiology. Visual psychophysics. vol. 7. Berlin: Springer-Verlag; 1972, pt. 4, pp. 170-187.

* cited by examiner

GOLF BALL WITH INDICIA FOR ALIGNMENT

This application is a continuation-in-part of U.S. Design patent application No. 29/431,250 filed Sep. 5, 2012 entitled Golf Ball Having Three Colored Parallel Lines, and a continuation-in-part of U.S. patent application Ser. No. 13/357,361 filed Jan. 24, 2012, entitled Golf Ball with Indicia for Alignment, which is a nonprovisional of U.S. Provisional Patent Application Ser. No. 61/483,999 filed May 9, 2011, entitled Golf Ball with Indicia for Alignment, and a continuation-in-part of U.S. Design patent application Ser. No. 29/388,964 filed Apr. 5, 2011 and issued as U.S. Pat. No. D655,358 on Mar. 6, 2012, the entire disclosures of which is incorporated herein by reference.

FIELD OF THE INVENTION

The present invention generally relates to golf balls, and more particularly to a golf ball having indicia for alignment.

BACKGROUND OF THE INVENTION

Golfers often have difficulty properly aligning a putter club head with a golf ball along an intended direction of ball travel and accurately stroking the putter club head through the ball along the intended direction. If the putter is aligned and strikes the ball true, it will follow the laws of physics and move in the direction struck. It is critical to not only strike the center of the ball with the center of gravity of the putter, but also at the correct angle. Using the tangent formula, for every one degree of deviation from a perpendicular, a strike of the ball will be deviated approximately 0.209 inches per foot of travel. For a ten foot putt, this translates to 2.09 inches. Thus, performance can be improved by improving the alignment of the putter with the ball.

Vernier acuity in visual psychophysics refers to the process of identifying offset in parallel lines or dots. It is known that humans are remarkably adept at performing a vernier acuity task. Thresholds of vernier acuity are on the order of detecting approximately 10-30 seconds of arc. This threshold is approximately ten times better than any other type of acuity task, such as recognition acuity. Accordingly, a putting system that incorporates a vernier acuity task will assist the user in aligning a putt.

The contents of the following are herein incorporated by reference: *How Vernier Acuity Depends on Contrast, Experimental Brain Research*, C. Wehrhahn & G. Westheimer (1990); *Sensation and Perception*, J. M. Wolfe, K. Kluender, D. M. Levi, L. M. Bartoshuk, R. Herz, & R. Klatzky (2008); *Temporal and Spatial Interference with Vernier Acuity, Vision Research*, G. Westheimer & G. Hauske (1975); *Development of VEP Vernier Acuity and Grating Acuity in Human Infants, Invest Ophthalmol Vis. Sci.*, Skoczenski & Norcia (September 1999); *Contrast Polarity, Chromaticity, and Stereoscopic Depth Modulate Contextual Interactions in Vernier Acuity, Journal of Vision*, B. Sayim, G. Westheimer & M. Herzog (2008); *Visual Acuity and Spacial Modulation Thresholds, Handbook of Sensory Physiology* Vol. 7, G. Westheimer (1972); and *Visual Acuity, Adler's Physiology of the Eye*, G. Westheimer (1987).

SUMMARY OF THE INVENTION

In one aspect, a golf ball with indicia for alignment comprises a golf ball having indicia adapted to allow a user to align the indicia with at least one of an intended direction of travel of the ball and a club head of a club the user will use to strike the ball. The indicia comprise three parallel lines extending around a portion of the golf ball at spaced intervals.

In another aspect, a golf ball with indicia for alignment comprises a golf ball having indicia adapted to allow a user to align the indicia with at least one of an intended direction of travel of the ball and a club head of a club the user will use to strike the ball. The indicia comprise three parallel lines extending around about one third of the golf ball at spaced intervals. The three parallel lines comprise two outer lines of blue indicia and an inner line of red indicia located between the two outer lines. The inner line of red indicia extends around about one third of the equator of the golf ball. The inner line indicates the intended direction of travel of the ball and indicates the location on the ball at which the ball should be contacted by the club head.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

In one form, the invention comprises a golf ball having multiple indicia allowing a golfer to align the indicia with the intended direction of the ball and to align the indicia with a club head of a club the golfer will use to strike the ball.

Figure 1:
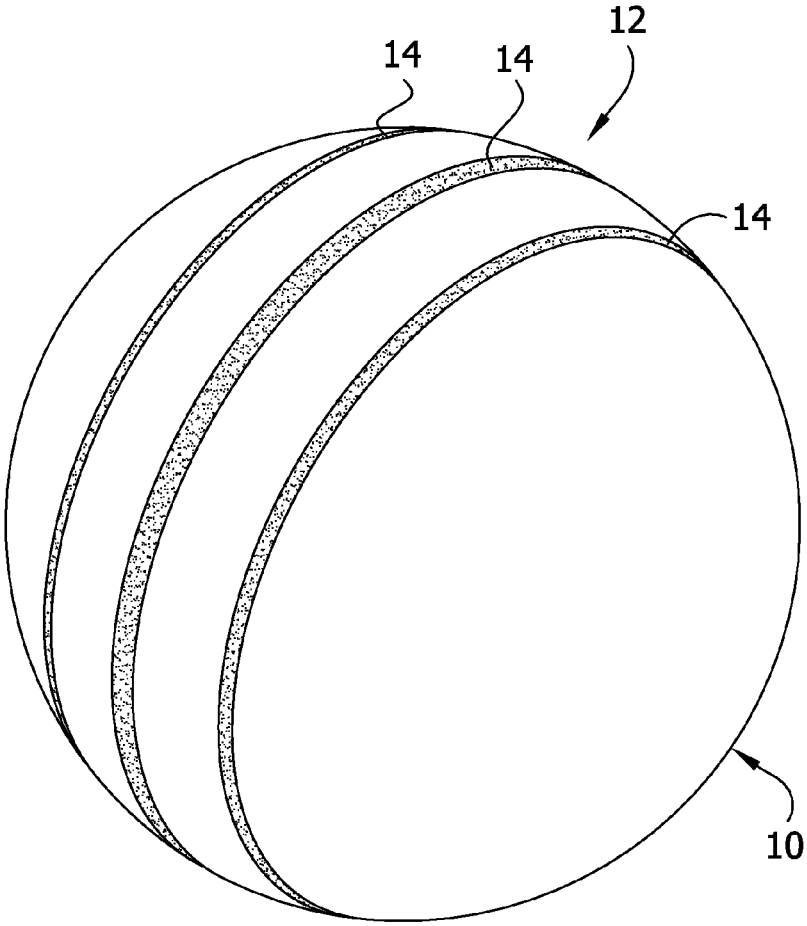
FIG. 1 is a perspective view of a first embodiment of a golf ball with indicia for alignment according to the present invention.

Referring to FIG. 1, a golf ball with indicia for visibility and alignment of one embodiment of the present invention is generally designated by the reference number 10. The golf ball 10 includes indicia, generally indicated at 12, which allows a user to more accurately align the golf ball, as described below.

The golf ball 10 may be a typical golf ball, preferably having a diameter of approximately 1.68 inches or greater, since United States Golf Association Rules dictate such a diameter for the golf ball. However, those skilled in the art will recognize that a ball with a smaller diameter may be used without departing from the scope of the present invention.

The golf ball 10 preferably has a white surface; however, other colors may be used for the surface of the golf ball without departing from the scope of the present invention.

The indicia 12 are printed on the surface of the golf ball 10. Preferably, the indicia 12 are printed on a base coat with a top coat applied over the indicia, as is known in the art. However, it is within the scope of the present invention that the indicia be printed on the top coat of the golf ball 10, or otherwise applied to the golf ball. Alternatively or in addition, the indicia 12 may be a layer added to the golf ball, such as tape or other material which would be adhered to the surface of the golf ball.

Figure 2:
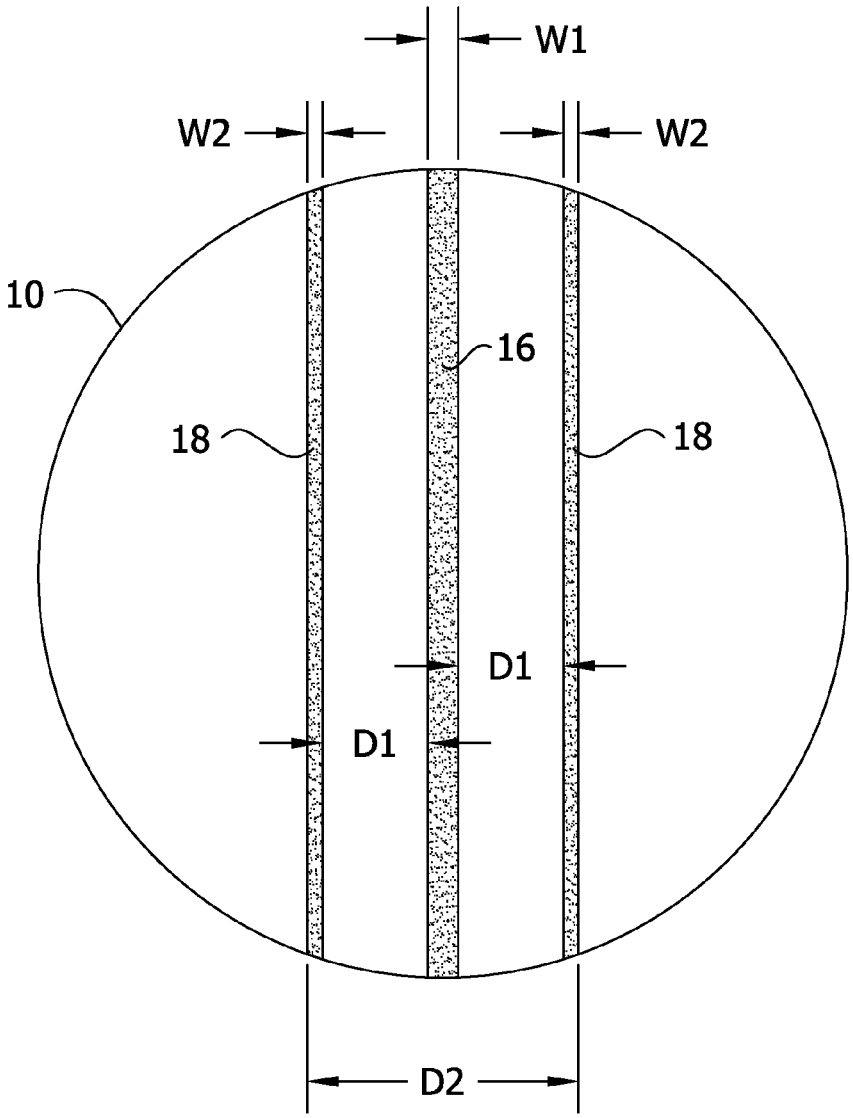
FIG. 2 is a top plan view thereof.
Figure 3:
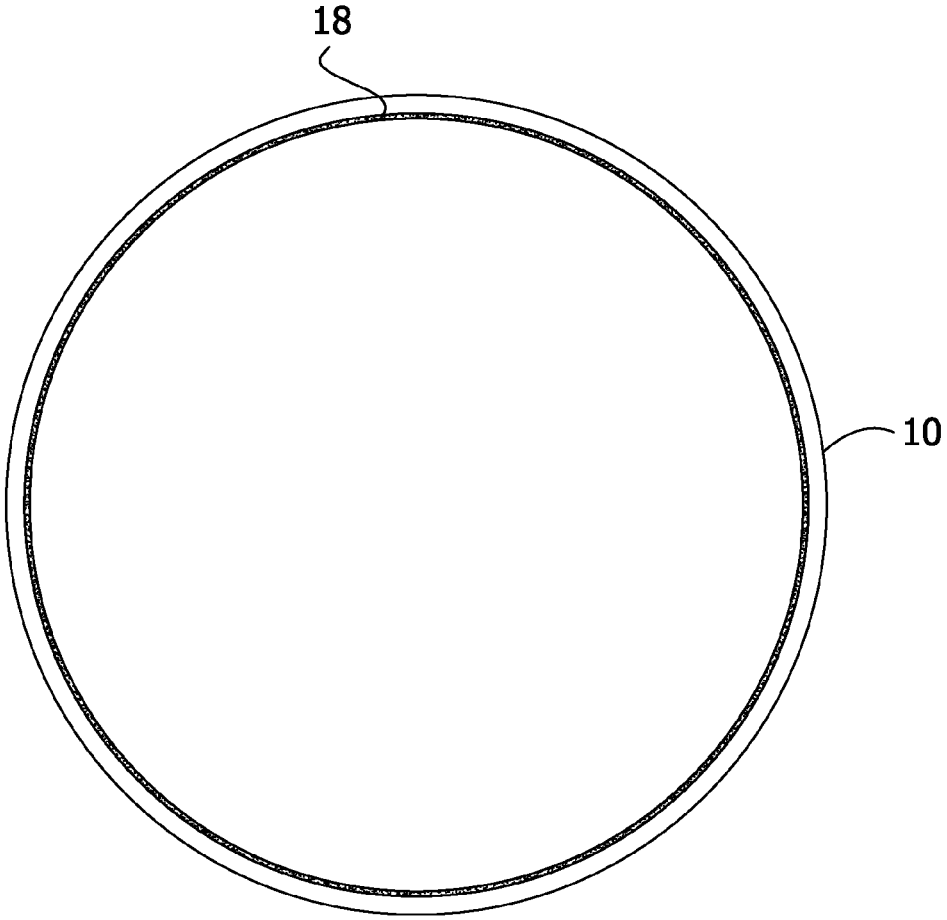
FIG. 3 is a side view thereof.

In one illustrated embodiment, the indicia 12 on the golf ball 10 include three parallel circles or bands 14 extending around the golf ball at spaced intervals. Preferably, the bands 14 are located more or less within the center third of the golf ball 10, although it is also contemplated that the bands 14 may be located more or less within the center one-sixth of the golf ball 10. As used herein, "more or less" or "about" means±25%. Referring to FIG. 2, the bands 14 of one embodiment will be described in more detail. An inner or central band or circle 16 extends around the golf ball 10, preferably at the equator or center of the ball. Two outer bands or circles 18 flank the inner circle 16 and extend around the golf ball 10 parallel to the inner circle and to each other. It is within the scope of the present invention that the golf ball includes a different number or configuration of parallel circles.

The three parallel circles 14 preferably stand out visually from the surface of the golf ball 10, such as by filling in the circles with color, shading, or patterns. More preferably, the two outer circles 18 are colored, shaded, or patterned identically, and the inner circle 16 is colored, shaded, or patterned differently than the outer circles. However, the inner and outer circles 16, 18 can be colored, shaded, or patterned identically within the scope of the present invention.

Figure 4:
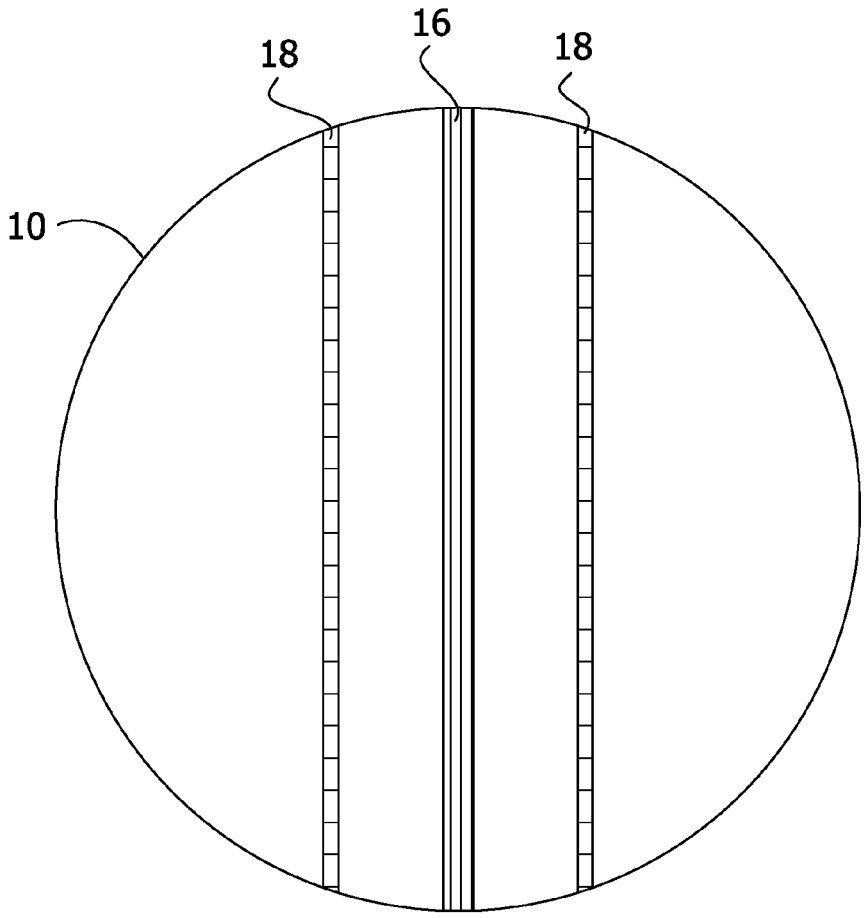
FIG. 4 is a top plan view of a second embodiment of a golf ball according to the present invention having two blue, spaced apart parallel outer circles and a red circle between and parallel to the two blue circles.
Figure 5:
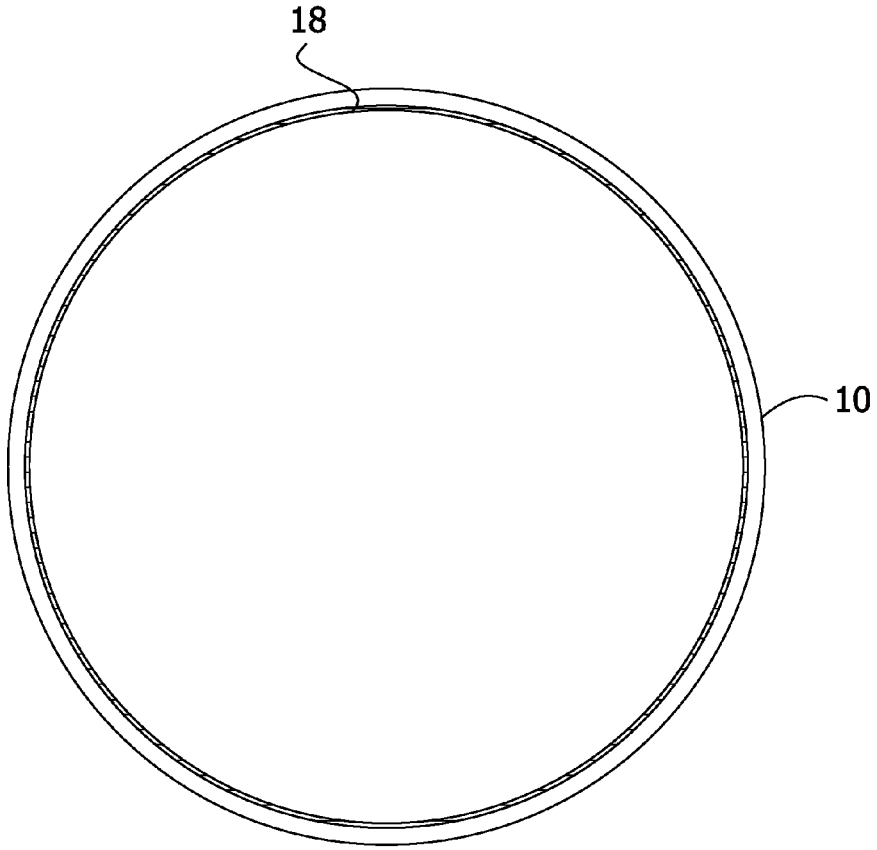
FIG. 5 is a side view of FIG. 4.

In the embodiment illustrated in FIGS. 4 and 5, the inner circle 16 is red, and the outer circles 18 are blue. Other color combinations are within the scope of the present invention. For example, the inner circle can be blue, and the outer circles can be red. Alternatively, the inner circle can be red and the outer circles can be green. It is contemplated in the field of visual psychophysics that contrast and certain colors help a user to identify offset in parallel lines. Particularly, vernier acuity is improved when the flanks (outer circles) contrast with the vernier line (inner circle). In one study, an optimum target had red vernier lines and green flanks. Accordingly, it is preferable for the inner circle to contrast with the outer circles.

In one embodiment, the outer circle 18 can be considered a target circle and the inner circles 16 are considered flank circles that flank the target circle. When viewed in this manner, the flank circles appear to encase the target circle causing the eye to focus on the target circle, which is the sight line for the direction of the ball. This configuration allows the golfer to more accurately align the target circle with the target (e.g., the flag, or cup) and/or to more accurately align the target circle with the intended direction of the ball. This configuration also provides a substantial benefit over only having a marking on a putter. Because the ball remains fixed and depends on a proper alignment with the putter to move the ball in the target direction, the target direction is more easily defined by the ball rather than the putter. In contrast, a marking on the putter tends to identify the location on the putter at which the ball should meet the putter when the ball is struck by the putter. Because the putter is in motion, there is a much greater potential for misdirection of the ball when relying on a marking on the putter when the ball is struck. Thus, the configuration of the invention indicates two aspects of striking the ball: first, the target circle indicates the intended direction of travel of the ball; and second, the target circle indicates the location on the ball at which the ball should be contacted by the club head.

This configuration of the invention also allows a golfer to remain focused and fixed on the target circle and, as a result, focused and fixed on the ball and its intended direction. In other words, the flank circles inhibit the eyes from unobstructed drifting or from being distracted from focusing on the target circle during alignment of the putter club head and the ball and during the striking of the ball when a golfer swings the putter. This is a significant advantage over balls having a single line because golfers find it harder to remain focused and fixed on a single line. In addition, when golf balls of the invention are used in conjunction with putters which have the same, similar or complimentary markings, the accuracy of a golfer is significantly improved by improving (1) the ability of a golfer to align the ball properly with the intended target; (2) the ability of a golfer to align the putter club head with the ball so it strikes the ball in the direction of the target; and (3) the ability of a golfer to strike the ball with the putter club head as aligned prior to the actual swing so that the ball is moved more accurately in the direction of the target.

Referring again to FIG. 2, the inner circle 16 has a width W1, which is preferably in a range of about 0.03125 (1/32) inches to 0.09375 (3/32) inches, and in one embodiment is about 0.0625 (1/16) inches. In another embodiment, the width W1 is about 0.03937 inches (1 mm). The outer circles 18 each have a width W2, which is preferably in a range of about 0.015625 (1/64) inches to 0.0625 (1/16) inches, and in one embodiment is about 0.03125 (1/32) inches. In another embodiment, the width W2 is about 0.01969 inches (0.5 mm). Other configurations of the inner and outer circles, such as all three circles having the same width or all three circles having different widths, are within the scope of the present invention.

The outer circles 18 are spaced a distance D1 from the inner circle 16. According to visual psychophysics perspective, flanks (outer circles 18) can cause a decrement in vernier acuity if the flanks are very close to the vernier line (inner circle 16), such as within 2-3 arc minutes. Therefore, a separation of more than 2-3 arc minutes is ideal for vernier acuity. For a standard golf ball 10 having a diameter of 1.68 inches, D1 is preferably at least about 0.114 inches. In one embodiment, each outer circle 18 is spaced the same distance D1 from the inner circle 16; however, other configurations are within the scope of the present invention. The distance D1 is preferably in a range of about 0.125 (1/8) inches to 0.3125 (5/16) inches, and in one embodiment is about 0.21875 (7/32) inches. In another embodiment, the distance D1 is about 0.25 (1/4) inches.

The parallel circles 14 span a distance D2 across the golf ball 10. The distance D2 is preferably in a range of about 25%-50% of the diameter of the ball, and more preferably is in a range of about 30%-35% of the diameter of the ball. If the golf ball 10 has a diameter of 1.68 inches, as discussed above, the distance D2 is preferably in a range of about 0.42 inches to 0.84 inches, and more preferably is in a range of about 0.504 inches to 0.588 inches. In one embodiment, the distance D2 is about 0.5625 (9/16) inches. In another embodiment, the distance D2 is about 0.625 (5/8) inches. In still another embodiment, the distance D2 is about 0.5787 inches.

Figure 6:
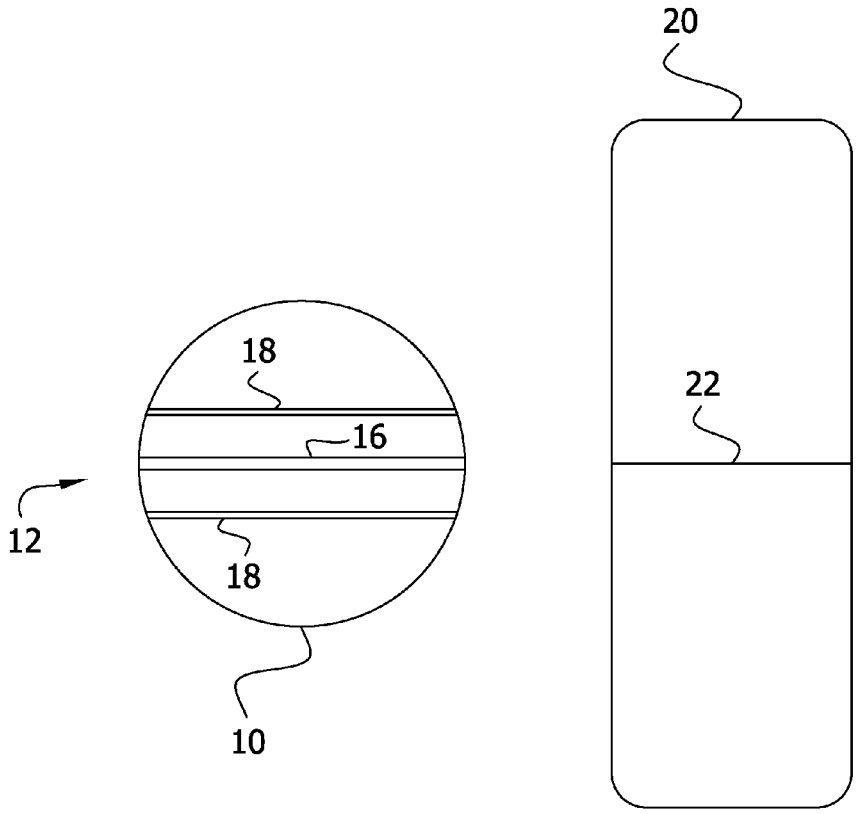
FIG. 6 is a schematic illustration of one embodiment of a golf ball according to the present invention and a golf club for use therewith.
Figure 7:
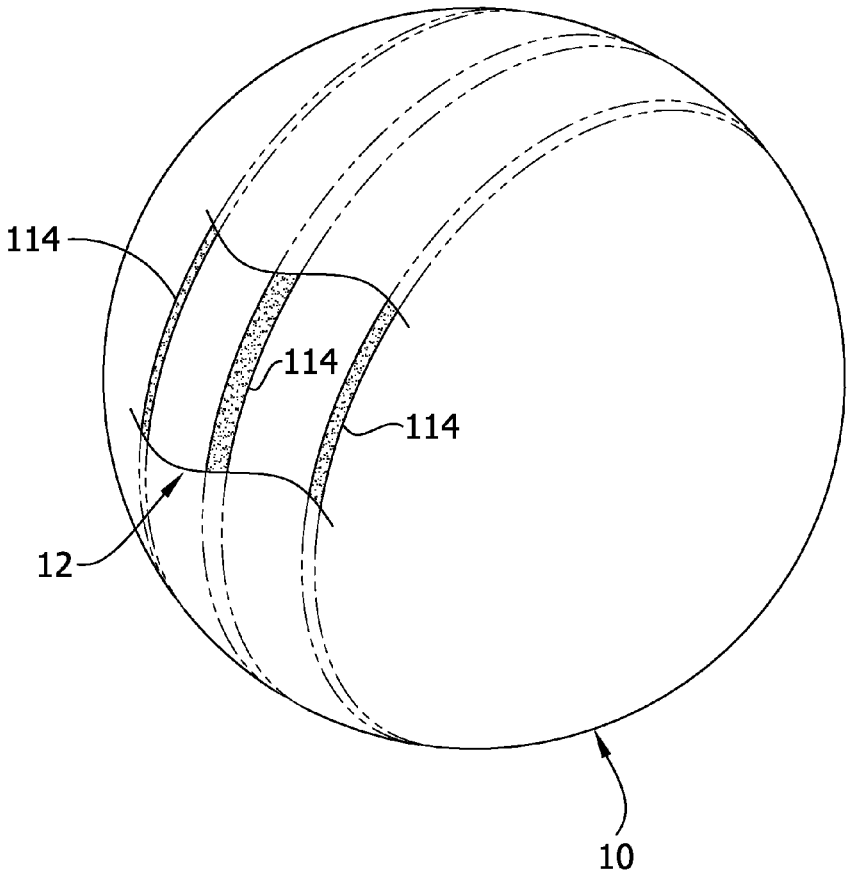
FIG. 7 is a perspective view of a third embodiment of a golf ball with indicia for alignment according to the present invention.

The golf ball 10 as described above allows a user to align the ball and improve accuracy in putting. In use in one embodiment, the user can align the indicia 12 on the golf ball 10 with the intended direction of travel, e.g., toward the center of the fairway, the target hole, flag or cup. The user then assumes his putting stance and aligns a putter club head 20 with the indicia 12, as seen in FIG. 6. More specifically, the user aligns a marking or line 22 on the putter club head 20 with the inner circle 16. The line 22 on the club head 20 is preferably located along the center of gravity of the club head, which is the optimal place on the club to strike a golf ball. The line 22 can be a simple line, as illustrated. Alternatively, the line 22 can be colored, shaded, or patterned. In one embodiment, the line 22 is colored, shaded, or patterned identically to the inner circle 16 of the golf ball 10. Preferably, the golf ball 10 and the putter 20 are sold together as a kit, with the indicia 12 of the golf ball and the line 22 of the putter matching.

As the user aligns the line 22 with the inner circle 16, the user is engaging in a vernier acuity task by attempting to align parallel lines. Because of the user's ability to adeptly perform this task and determine offset in the lines, as discussed above, the indicia 12 and the line 22 allow the user to strike the golf ball 10 in the center of the golf ball with the center of gravity of the club head 20. The characteristics of the indicia 12 discussed above, such as the width of the circles 16, 18, the distance between the circles, the color of the circles, and the span of the indicia, optimize the user's ability to determine any offset between the line 22 and the inner circle 16, thereby ensuring an optimal strike.

In another embodiment, the club head can include three lines, such that the user is performing three separate vernier acuity tasks by aligning each of the three circles on the golf ball with one of the three lines on the club head. Other configurations are within the scope of the present invention.

Alternatively, the user can use the golf ball 10 with any golf club to improve the alignment and accuracy of the user's strike. It is within the scope of the present invention that any club other than a putter can also be used with the golf ball 10, and can include matching markings to assist the user in aligning a shot.

Figure 8:
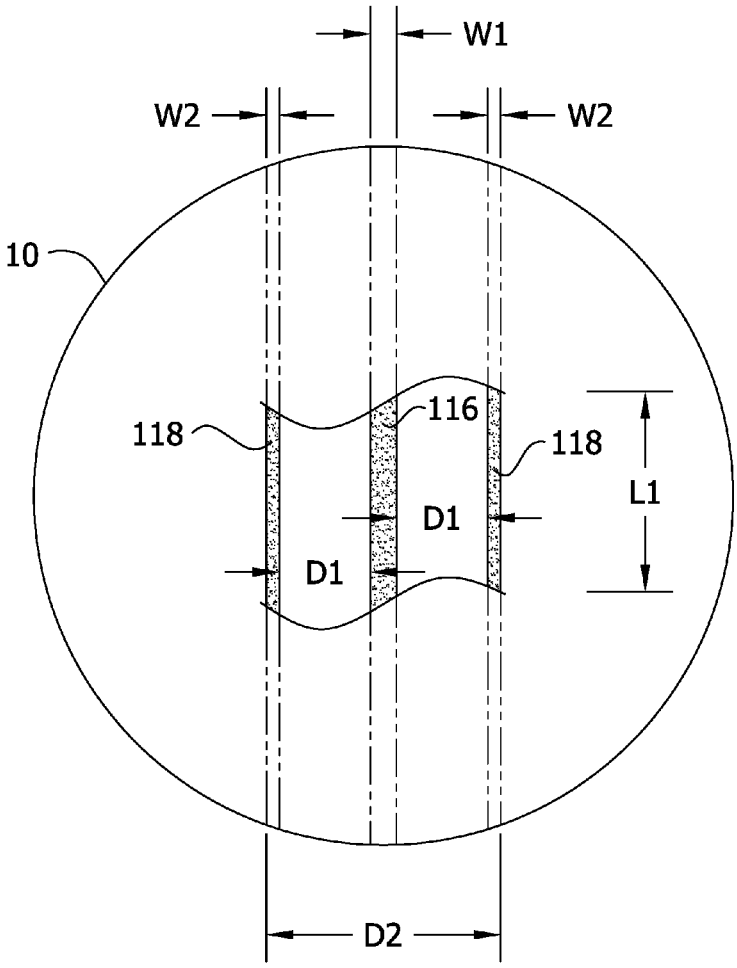
FIG. 8 is a top plan view of FIG. 7.
Figure 9:
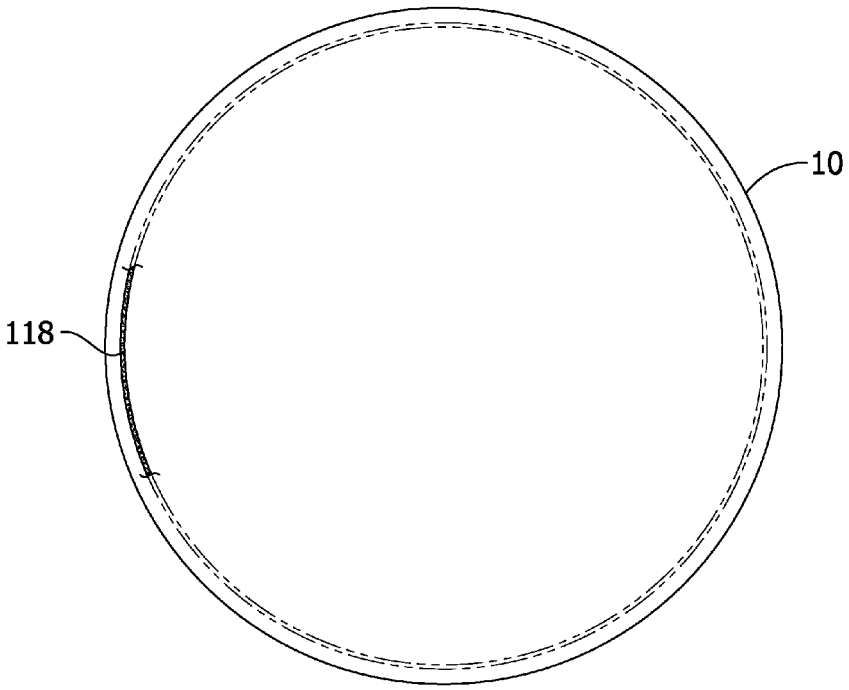
FIG. 9 is a side view of FIG. 7.

In the embodiment illustrated in FIGS. 7-12, the indicia 12 on the golf ball 10 include three parallel lines 114 extending around a portion of the golf ball at spaced intervals. In one embodiment, the lines 114 extend around at least about one sixth (a 60 degree arc) or more of the golf ball 10. In another embodiment, the lines 114 extend around at least about one half (a 180 degree arc) or more of the golf ball 10. Preferably, the lines 114 are located more or less within the center third of the golf ball 10 and extend around only one third (a 120 degree arc) of the golf ball. Referring to FIG. 8, the lines 114 of one embodiment will be described in more detail. An inner or central line 116 extends around a portion of the golf ball 10, preferably at the equator or center of the ball. Two outer lines 118 flank the inner line 116 and extend around a portion of the golf ball 10 parallel to the inner line and to each other. It is within the scope of the present invention that the golf ball includes a different number or configuration of parallel lines.

The three parallel lines 114 preferably stand out visually from the surface of the golf ball 10, such as by filling in the lines with color, shading, or patterns. More preferably, the two outer lines 118 are colored, shaded, or patterned identically, and the inner line 116 is colored, shaded, or patterned differently than the outer lines. However, the inner and outer lines 116, 118 can be colored, shaded, or patterned identically within the scope of the present invention.

Figure 10:
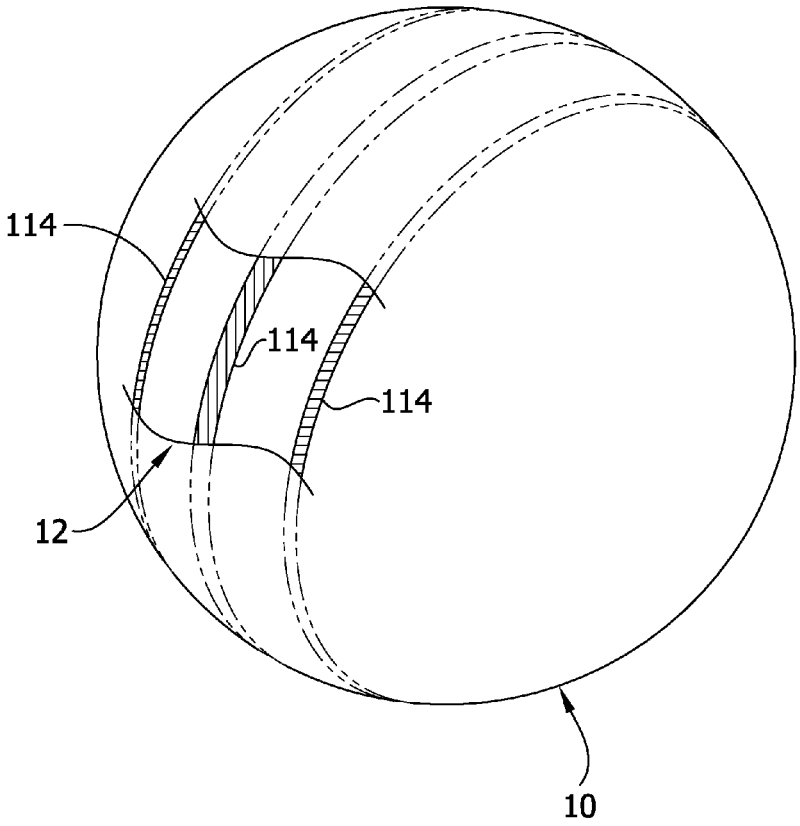
FIG. 10 is a perspective view of a fourth embodiment of a golf ball according to the present invention having two blue, spaced apart parallel outer lines and a red line between and parallel to the two blue lines.
Figure 11:
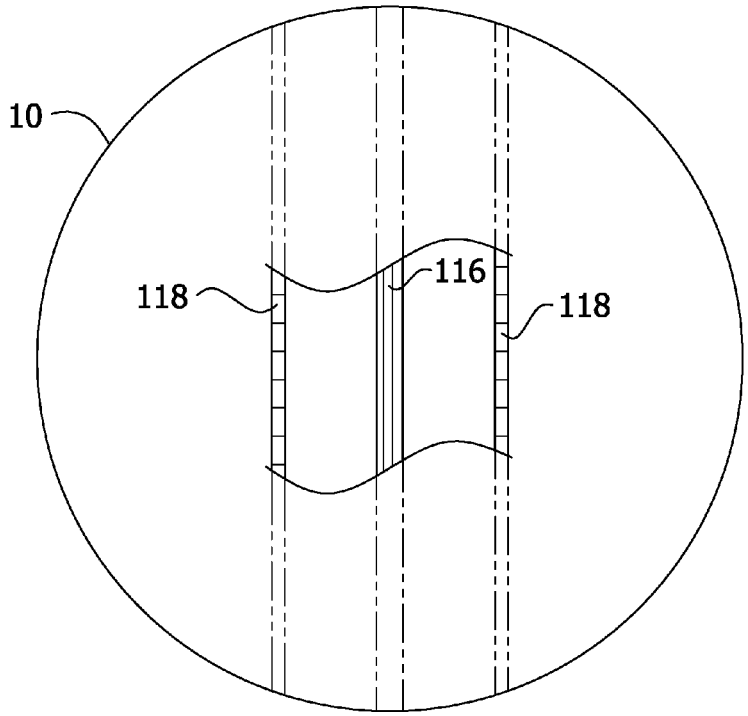
FIG. 11 is a top plan view of FIG. 10.
Figure 12:
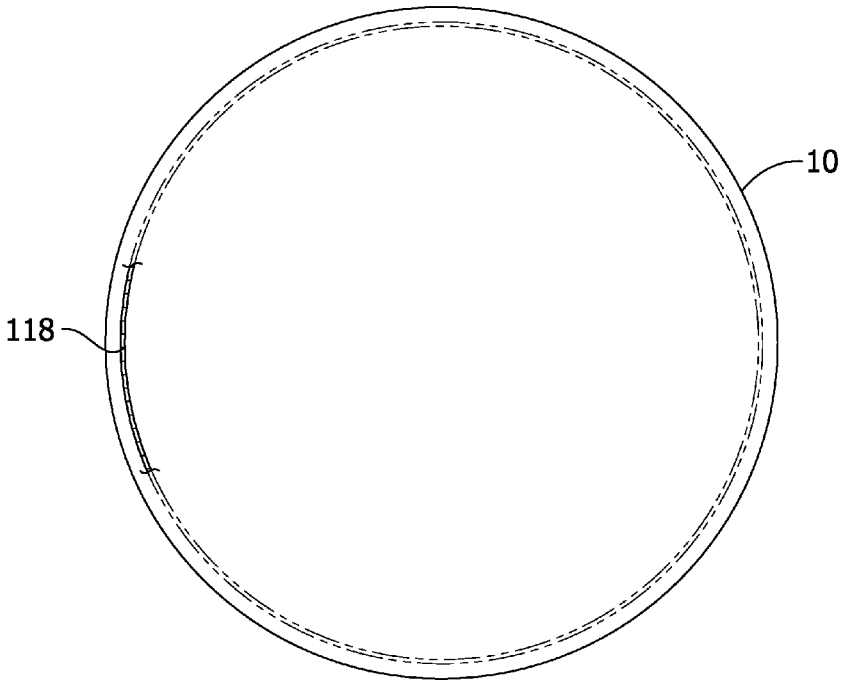
FIG. 12 is a side view of FIG. 10.

In the embodiment illustrated in FIGS. 10-12, the inner line 116 is red, and the outer lines 118 are blue. Other color combinations are within the scope of the present invention. For example, the inner line can be blue, and the outer lines can be red. Alternatively, the inner line can be red and the outer lines can be green. It is contemplated in the field of visual psychophysics that contrast and certain colors help a user to identify offset in parallel lines. Particularly, vernier acuity is improved when the flanks (outer lines) contrast with the vernier line (inner line). In one study, an optimum target had red vernier lines and green flanks. Accordingly, it is preferable for the inner line to contrast with the outer lines.

In one embodiment, the inner line 116 can be considered a target line and the outer lines 118 are considered flank lines that flank the target line. When viewed in this manner, the flank lines appear to encase the target line causing the eye to focus on the target line, which is the sight line for the direction of the ball. This configuration allows the golfer to more accurately align the target line with the target (e.g., the flag, or cup) and/or to more accurately align the target line with the intended direction of the ball. This configuration also provides a substantial benefit over only having a marking on a putter. Because the ball remains fixed and depends on a proper alignment with the putter to move the ball in the target direction, the target direction is more easily defined by the ball rather than the putter. In contrast, a marking on the putter tends to identify the location on the putter at which the ball should meet the putter when the ball is struck by the putter. Because the putter is in motion, there is a much greater potential for misdirection of the ball when relying on a marking on the putter when the ball is struck. Thus, the configuration of the invention indicates two aspects of striking the ball: first, the target line indicates the intended direction of travel of the ball; and second, the target line indicates the location on the ball at which the ball should be contacted by the club head.

This configuration of the invention also allows a golfer to remain focused and fixed on the target line and, as a result, focused and fixed on the ball and its intended direction. In other words, the flank lines inhibit the eyes from unobstructed drifting or from being distracted from focusing on the target line during alignment of the putter club head and the ball and during the striking of the ball when a golfer swings the putter. This is a significant advantage over balls having a single line because golfers find it harder to remain focused and fixed on a single line. In addition, when golf balls of the invention are used in conjunction with putters which have the same, similar or complimentary markings, the accuracy of a golfer is significantly improved by improving (1) the ability of a golfer to align the ball properly with the intended target; (2) the ability of a golfer to align the putter club head with the ball so it strikes the ball in the direction of the target; and (3) the ability of a golfer to strike the ball with the putter club head as aligned prior to the actual swing so that the ball is moved more accurately in the direction of the target.

Referring again to FIG. 8, the inner line 116 has a width W1, which is preferably in a range of about 0.03125 (1/32) inches to 0.09375 (3/32) inches, and in one embodiment is about 0.0625 (1/16) inches. In another embodiment, the width W1 is about 0.03937 inches (1 mm). The outer lines 118 each have a width W2, which is preferably in a range of about 0.015625 (1/64) inches to 0.0625 (1/16) inches, and in one embodiment is about 0.03125 (1/32) inches. In another embodiment, the width W2 is about 0.01969 inches (0.5 mm). Other configurations of the inner and outer lines, such as all three lines having the same width or all three lines having different widths, are within the scope of the present invention.

The outer lines 118 are spaced a distance D1 from the inner line 116. According to visual psychophysics perspective, flanks (outer lines 118) can cause a decrement in vernier acuity if the flanks are very close to the vernier line (inner line 116), such as within 2-3 arc minutes. Therefore, a separation of more than 2-3 arc minutes is ideal for vernier acuity. For a standard golf ball 10 having a diameter of 1.68 inches, D1 is preferably at least about 0.114 inches. In one embodiment, each outer line 118 is spaced the same distance D1 from the inner line 116; however, other configurations are within the scope of the present invention. The distance D1 is preferably in a range of about 0.125 (1/8) inches to 0.3125 (5/16) inches, and in one embodiment is about 0.21875 (7/32) inches. In another embodiment, the distance D1 is about 0.25 (1/4) inches.

The parallel lines 114 span a distance D2 across the golf ball 10. The distance D2 is preferably in a range of about 25%-50% of the diameter of the ball, and more preferably is in a range of about 30%-35% of the diameter of the ball. If the golf ball 10 has a diameter of 1.68 inches, as discussed above, the distance D2 is preferably in a range of about 0.42 inches to 0.84 inches, and more preferably is in a range of about 0.504 inches to 0.588 inches. In one embodiment, the distance D2 is about 0.5625 (9/16) inches. In another embodiment, the distance D2 is about 0.625 (5/8) inches. In still another embodiment, the distance D2 is about 0.5787 inches.

The parallel lines 114 extend along only a portion of the golf ball 10, in contrast to the parallel circles 14 described above that extend around the entirety of the golf ball. As illustrated, the parallel lines 114 have a length L1. The length L1 is preferably in a range of about 15%-50% of the circumference of the ball, and more preferably is in a range of about 30%-35% of the circumference of the ball. In one embodiment, the parallel lines 114 extend around at least about one sixth of the golf ball 10. In another embodiment, the parallel lines 114 extend around approximately one third of the golf ball 10. Other configurations of the parallel lines 114 are within the scope of the present invention. The parallel lines 114 can extend around any portion of the golf ball 10.

The golf ball 10 as described above allows a user to align the ball and improve accuracy in putting. The golf ball 10 including parallel lines 114 is used similar to the golf ball including parallel circles 14 described above. In use in one embodiment, the user can align the indicia 12 on the golf ball 10 with the intended direction of travel, e.g., toward the center of the fairway, the target hole, flag or cup. The user then assumes his putting stance and aligns a putter club head with the indicia 12. More specifically, the user aligns a marking or line on the putter club head with the inner line 116. The line on the club head is preferably located along the center of gravity of the club head, which is the optimal place on the club to strike a golf ball. The line on the putter head can be a simple line. Alternatively, the line can be colored, shaded, or patterned. In one embodiment, the line is colored, shaded, or patterned identically to the inner line 116 of the golf ball 10. Preferably, the golf ball 10 and the lined putter are sold together as a kit, with the indicia 12 of the golf ball and the line of the putter matching.

As the user aligns the line on the putter head with the inner line 116, the user is engaging in a vernier acuity task by attempting to align parallel lines. Because of the user's ability to adeptly perform this task and determine offset in the lines, as discussed above, the indicia 12 and the line on the putter head allow the user to strike the golf ball 10 in the center of the golf ball with the center of gravity of the club head. The characteristics of the indicia 12 discussed above, such as the width of the lines 116, 118, the distance between the lines, the color of the lines, and the span of the indicia, optimize the user's ability to determine any offset between the line on the putter head and the inner line 116, thereby ensuring an optimal strike.

In another embodiment, the club head can include three lines, such that the user is performing three separate vernier acuity tasks by aligning each of the three lines on the golf ball with one of the three lines on the club head. Other configurations are within the scope of the present invention.

Alternatively, the user can use the golf ball 10 with any golf club to improve the alignment and accuracy of the user's strike. It is within the scope of the present invention that any club other than a putter can also be used with the golf ball 10, and can include matching markings to assist the user in aligning a shot.

Example 1

An accuracy study was conducted to determine the benefits of a golf ball according to one embodiment of the present invention.

A golf ball was marked with a center red stripe 0.03937 inches (1 mm) in width and green flanks 0.01969 inches (0.5 mm) in width. The center red stripe was aligned with the equator of the ball, and each green flank was spaced 0.25 (1/4) inches from the center red stripe. A laser (model DL3149 with 670 nm wavelength and 5 mW max power) was installed in the exact center of the ball and aligned with the center red stripe. The ball had a remote magnetically controlled on/off switch to allow an operator to turn the laser on without touching the ball.

A non-striped golf ball was used for comparison purposes. For the non-striped ball, the normal text printed on the ball was used to center the laser within the ball.

An artificial putting green was constructed with standard golf cups installed at 5 feet and 10 feet from the end of the green. The golf cup accepted a measuring scale that extended 4.921 inches (125 mm) right and left from the center.

A random sample of subjects was recruited from a local golf course and from students at the University of Missouri St. Louis. A total of 52 subjects were tested.

Subjects were asked demographic/golf experience questions (age, gender, golf experience). Subjects were then asked to align golf balls to a hole target a total of 4 times (2 golf ball types (striped and non-striped), 2 distances (5 ft and 10 ft)). Subjects were also asked to judge their confidence of each alignment on a scale of 1-5.

The order of cup/ball testing was completely randomized. Subjects were asked to align each ball-cup combination and asked to rate their confidence on a Likert Scale.

Aiming accuracy, confidence in aiming, and ball preference was tested in 52 subjects with a wide range of golfing experience and ability. Males were heavily represented in this study, 47/52 subjects. 19/52 subjects did not have a golf handicap and were characterized as "less experienced."

IBM SPSS Statistics (Version 19) program was used for the analysis. For statistical purposes, subjects who had no handicap were given the value of 40. If subjects alignment was "off scale" from the hole it was given a value of 150 mm. Correlations, paired t-test, and repeated measures were used to compare accuracy, confidence, and preferences. Subjects were asked how confident they were that their alignment was with the center of the cup: Strongly Unconfident, Unconfident, Neutral, Confident, or Strongly Confident. After testing was completed, subjects were asked to state a preference for a ball type: Striped, Non-striped, or No Preference.

Not surprising, subjects were more accurate with aiming at 5 ft than at 10 ft from the cup. Subjects had an increase in accuracy of 11.1% with the striped ball according to the present invention compared to the non-striped ball at 5 ft, and an 11.9% increase in accuracy with the striped ball compared to the non-striped ball at 10 ft. There was no association between golf handicap and improvement in accuracy at 5 ft or at 10 ft.

Subjects were significantly more confident with the striped golf ball in their aiming accuracy at 5 ft, and even more so at 10 ft. There was no association between golf handicap and improvement in confidence at 5 ft or at 10 ft.

Overall for subjects who had a ball preference, 62% preferred the striped ball, compared to 38% for the non-striped ball. For the more inexperienced golfers with a preference, the striped ball was preferred by 71% of those tested, while 29% preferred the non-striped ball.

This novel study was designed to assess the accuracy of aligning a golf ball. Using this system, we found that subjects were better in aiming the striped ball according to an embodiment of the present invention on average as compared to a standard non-striped golf ball. This improvement was found at both 5 ft and 10 ft. Subjects were more confident in how they aimed the striped ball at 5 ft, and had a significant improvement in confidence of their aiming ability at 10 ft compared to the standard non-striped ball. Higher confidence could play a role in the subjective component part of the game, and could further improve a golfer's putting. Further, inexperienced golfers who had a preference preferred the striped ball by a factor of 2.5:1 over the standard non-striped golf ball.

This study indicates some of the benefits of the striped golf ball according to the present invention. However, there were a limited number of participants, and a larger study with a wider range of participants might prove an even greater improvement in golf ball alignment due to the inventive features of the present invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the invention by way of example and not by way of limitation. This description enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A golf ball with indicia for alignment comprising:

a golf ball; and indicia on the golf ball, said indicia comprising only three parallel lines presenting an image for a vernier acuity task extending around a portion of the golf ball at spaced intervals, the three parallel lines comprising two outer lines and an inner line located between the two outer lines, each of said two outer lines having a width smaller than a width of said inner line;

said indicia adapted to allow a user to align the indicia with at least one of an intended direction of travel of the ball and a club head of a club the user will use to strike the ball, said indicia spanning a total distance in a range of about 0.42 inches to about 0.84 inches, whereby said user performs the vernier acuity task to align the indicia.

2. The golf ball of claim 1, wherein the indicia spans a total distance of 0.5625 inches.

3. The golf ball of claim 1, wherein the indicia spans a total distance of 0.5787 inches.

4. The golf ball of claim 1, wherein the indicia spans a total distance of 0.625 inches.

5. The golf ball of claim 1 including one of the following:

wherein the indicia extends around more or less one third of the golf ball; and wherein the indicia extends around more or less one sixth of the golf ball.

6. The golf ball of claim 1, wherein each of the three parallel lines extends around only one third of the golf ball.

7. The golf ball of claim 1, wherein each of the three parallel lines extends around about one half of the golf ball.

8. The golf ball of claim 1, wherein the inner line extends around a portion of the equator of the golf ball.

9. The golf ball of claim 8, wherein the two outer lines are green, and the inner line is red.

10. The golf ball of claim 8, wherein the two outer lines are blue, and the inner line is red.

11. The golf ball of claim 8, wherein the two outer lines are at least one of colored, patterned, and shaded identically.

12. The golf ball of claim 11, wherein the inner line is at least one of colored, patterned, and shaded differently than the two outer lines.

13. The golf ball of claim 8 wherein the inner line comprises a target line indicating the intended direction of travel of the ball and indicating the location on the ball at which the ball should be contacted by the club head.

14. The golf ball of claim 8, wherein each of the two outer lines is spaced a distance of at least 0.114 inches from the inner line.

15. The golf ball of claim 14, wherein each of the two outer lines is spaced a distance of 0.25 inches from the inner line.

16. The golf ball of claim 8, wherein the inner line has a width of 0.03937 inches (1 mm).

17. The golf ball of claim 16, wherein each of the two outer lines has a width of 0.01969 inches (0.5 mm).

18. The golf ball of claim 8, wherein the inner line has a width of 0.0625 inches.

19. The golf ball of claim 18, wherein each of the two outer lines has a width of 0.03125 inches.

20. A golf ball with indicia for alignment comprising:

a golf ball having indicia adapted to allow a user to align the indicia with at least one of an intended direction of travel of the ball and a club head of a club the user will use to strike the ball;

said indicia comprising only three parallel lines presenting an image for a vernier acuity task extending around one third of the golf ball at spaced intervals, said indicia spanning a total distance in a range of about 0.42 inches to about 0.84 inches;

wherein the three parallel lines comprise two outer lines of blue indicia and an inner line of red indicia located between the two outer lines, the inner line of red indicia extending around one third of the equator of the golf ball; and wherein the inner line indicates the intended direction of travel of the ball and indicates the location on the ball at which the ball should be contacted by the club head, whereby the user performs the vernier acuity task to align the indicia of the golf ball with the marking of the club head.

* * * * *